US011937678B2

(12) United States Patent
Ashkenazi et al.

(10) Patent No.: US 11,937,678 B2
(45) Date of Patent: Mar. 26, 2024

(54) AUTO-ROTATE HAIR IRON ASSEMBLY AND METHOD OF STYLING HAIR TO ACHIEVE AT LEAST ONE CURL STYLE BASED ON EXTENT OF ROTATION

(71) Applicant: Natan Ashkenazi

(72) Inventors: Natan Ashkenazi, New York, NY (US); Merry Riehm-Constantino, Buffalo, NY (US); David Moomaw, East Aurora, NY (US); Daniel Buckmaster, Amherst, NY (US); Amy B. Hangen, Clarence, NY (US)

( * ) Notice: Subject to any disclaimer, the term of this patent is extended or adjusted under 35 U.S.C. 154(b) by 881 days.

(21) Appl. No.: 17/006,578

(22) Filed: Aug. 28, 2020

(65) Prior Publication Data

US 2021/0059375 A1 Mar. 4, 2021

Related U.S. Application Data

(63) Continuation-in-part of application No. 16/555,103, filed on Aug. 29, 2019, now Pat. No. 10,799,005.

(51) Int. Cl.

| | |
|---|---|
| ***A45D 1/10*** | (2006.01) |
| ***A45D 1/00*** | (2006.01) |
| ***A45D 1/04*** | (2006.01) |
| ***A45D 6/04*** | (2006.01) |

(52) U.S. Cl.

CPC ..... *A45D 1/10* (2013.01); *A45D 1/04* (2013.01); *A45D 6/04* (2013.01); *A45D 2001/002* (2013.01)

(58) Field of Classification Search

CPC ... A45D 1/10; A45D 1/04; A45D 6/04; A45D 2001/002

USPC ..... 34/523, 95–100

See application file for complete search history.

(56) References Cited

U.S. PATENT DOCUMENTS

| | | | | |
|---|---|---|---|---|
| 4,211,914 | A | 7/1980 | Jackson | |
| 4,267,431 | A | 5/1981 | Rick | |
| 4,829,156 | A | 5/1989 | Thompson | |
| 5,621,979 | A * | 4/1997 | Taylor | A46B 13/02 248/522 |
| 7,045,744 | B2 | 5/2006 | Oh | |
| 8,272,142 | B2 * | 9/2012 | Hall | A45D 20/12 132/271 |
| 9,408,452 | B1 * | 8/2016 | Al-Khulaifi | A46B 15/0002 |
| 10,799,005 | B1 * | 10/2020 | Ashkenazi | A45D 1/04 |

(Continued)

*Primary Examiner* — Stephen M Gravini

(74) *Attorney, Agent, or Firm* — The Law Office of Vincent LoTempio, PLLC; Vincent G. LoTempio; Robert Cerasa

(57) ABSTRACT

An auto-rotate flat iron assembly that can be turned into a curling iron by a simple press of a button. It automates the rotation of the clamped strands of hair in order to create different curl styles. The hair iron assembly creates curls in hair by adjustably applying heat, clamping around hair strands, and automating rotation of the tongs in either direction, so as to achieve the desired wave or curl in hair. A stop member restricts rotation to 180°. A power button powers on and off a motor. A rotate button rotates the tongs in both directions 180° and up to or greater than 360°. A heat button incrementally increases and decreases heat in tongs. A tong lever controls opening and closing of tongs around hair strands. Different hair curl styles are achieved by changing heat temperature and/or speed of pulling down the iron after the rotation is complete.

20 Claims, 9 Drawing Sheets

(56) References Cited

U.S. PATENT DOCUMENTS

| | | | | |
|---|---|---|---|---|
| D924,484 | S * | 7/2021 | Cooper | D28/35 |
| 11,464,313 | B2 * | 10/2022 | Wang | A45D 20/12 |
| 11,571,056 | B2 * | 2/2023 | Min | A45D 20/00 |
| D990,045 | S * | 6/2023 | de Belizal | D28/35 |
| 2004/0237990 | A1 * | 12/2004 | Choi | A45D 1/04 132/224 |
| 2013/0192625 | A1 * | 8/2013 | Migliori | A45D 1/28 132/211 |
| 2013/0240498 | A1 * | 9/2013 | Tang | A45D 1/04 219/225 |
| 2016/0255935 | A1 * | 9/2016 | Li | A45D 2/367 |
| 2021/0059375 | A1 * | 3/2021 | Ashkenazi | A45D 1/04 |

* cited by examiner

AUTO-ROTATE HAIR IRON ASSEMBLY AND METHOD OF STYLING HAIR TO ACHIEVE AT LEAST ONE CURL STYLE BASED ON EXTENT OF ROTATION

This application is a continuation-in-part of and claims the benefit of priority from co-pending U.S. patent application Ser. No. 16/555,103, filed Aug. 29, 2019, the full disclosure of which is incorporated herein by reference.

FIELD OF THE INVENTION

The present invention relates generally to an auto-rotate hair iron assembly and method of styling hair to achieve at least one curl style based on extent of rotation. More so, the present invention relates to a hair iron assembly that creates waves or curls in the hair by clamping around a strand of hair, applying heat, and then automating the rotation of the clamps to rotate up to 180° in either direction, so as to achieve the desired wave or curl in the hair. In this manner, a "flat iron" is turned into a "curling" iron with a simple press of a button.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, a hair iron is a cosmetic tool that is used to style hair into a variety of styles, such as by curling hair to achieve a curl that does not naturally occur in the hair and by straightening hair to remove a kink or curl that does naturally occur in that hair.

It is known in the art that there is a clear distinction between curling irons and flat irons. Generally, a woman will have to buy a separate "curling" iron to curl her hair and a separate "flat" iron to straighten her hair.

Though a regular flat iron assembly may also be used to curl hair by simply closing the clamps and manually flipping the iron. Unfortunately, twisting the flat iron manually is a slow and awkward process in which the entire flat iron must be manually rotated. Such twisting requires the use of two hands. This creates difficulties for self-styling the hair.

There are different types and sizes of flat irons in the market. Some of them can be used also to curl the hair. However, self-curling the hair with a flat iron requires an awkward flipping motion, in which the flat iron must be manually rotated at the top of the hair before pulling it all the way down. Even though the above cited flat iron assemblies meet some of the needs of the market, an auto-rotate hair iron assembly and method of styling hair for creating waves or curls in the hair by clamping a strand of hair, applying heat, and then automating the rotation of the clamps to rotate more than 90° in either direction, so as to achieve the desired wave or curl in the hair, is still desired.

SUMMARY

Illustrative embodiments of the disclosure are generally directed to an auto-rotate flat iron assembly aimed to turn a flat iron into a curling iron by a simple press of a button. The flat iron assembly serves to alter the shape of hair strands using the flat iron's heated clamps that automatically twist strands of hair. The flat iron assembly creates waves or curls in the hair by clamping around a strand of hair, applying heat, and then automating the rotation of the clamps to rotate up to 90° in either direction for loose wave curls, or above 90 degrees for tighter curls, and finally pulling all the way down so as to achieve the desired wave or curl in the hair. The lever is then released to open the clamps and trigger them to rotate backwards to their original state. Ultimately, the flat iron which is usually used to straighten hair can be turned also into a "curling" iron with a simple press of a button. A heat switch controls a heating element in the tongs to generate variable amounts of heat. A stop member restricts rotation up to 180°. This is shown in FIG. 1*a*. A power button is operable to power on and off a motor. A rotate button is operable to rotate the clamps in both directions. In another embodiment, the tongs rotate up to 90 degrees for looser curls and greater than 90 degrees for tighter curls.

In one aspect, the auto-rotate hair iron assembly, comprises:

- a handle defined by a cavity, the handle comprising a power switch, a rotate switch, and a heat switch;
- a motor disposed inside the cavity of the handle, the motor being operatively connected to the power switch and the rotate switch, whereby the power switch selectively powers on and off the motor;
- a drive shaft defined by a handle end and a tong end, the drive shaft disposed inside the cavity of the handle along a central axis, the handle end of the drive shaft being operatively connected to the motor and the rotate switch;
- a stop member restricting rotation of the drive shaft;
- a pair of scissor-like tongs arranged in a spring-loaded, clamping relationship, the tongs defined by a first end rotatably coupled to the tong end of the drive shaft, whereby the rotation switch selectively drives the tongs into rotation, the tongs further being defined by a second end spaced from the first end in a direction of elongation,
- the tongs being biased in a open position for receiving and withdrawing hair strands;
- a tong lever operatively connected to the first end of the tongs, the tong lever being operable to displace the tongs to the closed position for retaining hair strands;
- an elongated heating element disposed within the tongs and extending partially in the direction of elongation between the first end and the second ends of the tongs, the heating element being operatively connected to the heat switch, whereby the heat switch selectively increases or decreases the heating element temperature.

In another aspect, the assembly further comprises a power cord couple to an external power source from one end, and to the motor from an opposite end.

In another aspect, the assembly further comprises a power cord connector joining the power cord to the motor directly, or indirectly.

In another aspect, the motor comprises a 460 rpm micro-gear motor.

In another aspect, the stop member restricts rotation of the drive shaft to 180° in two directions.

In another aspect, the assembly further comprises a power supply, the power supply being operatively connected to the motor.

In another aspect, the assembly further comprises a circuitry.

In another aspect, the assembly further comprises a ceramic housing encapsulating the tongs.

In another aspect, the assembly further comprises a spring disposed at the first end of the tongs.

In another aspect, the assembly further comprises a printed circuit board operatively connected to the motor and the heating element.

In another aspect, the assembly further comprises a drive shaft operatively connected to the motor and the drive shaft.

In another aspect, the center rod assembly comprises at least one cam fixedly attached proximately to a first end of the center rod assembly and a wedge at a second end of the center rod assembly.

In another aspect, the stop member restricts rotation of the drive shaft up to 90 degrees in at least one direction in order to achieve looser wave curls, or above 90 degrees in order to achieve tighter curls.

In another aspect, the motor comprises a 460 rpm micro-gear motor.

In another aspect, the collar end gear rotationally drives a ring gear, the rig gear being fixedly attached to the collar.

In another aspect, the collar end gear, the limit trigger, and the ring gear are disposed inside the collar cavity.

In another aspect, the collar and the tongs are mechanically connected through a tong bracket and multiple tong pins.

In another aspect, the stop member restricts rotation of the drive shaft at the predetermined rotation range by engaging a flanged ring to restrict rotation of the drive shaft to 180 degrees.

The benefits of the assembly are very tangible, a customer can purchase one tool that will function as a flat iron and/or curling iron.

Another benefit is that this method of curling the hair makes the process easy and almost effortless for all users. It only requires closing the clamps and pressing the button that rotates the top of the tool before pulling all the way down.

Yet another important benefit is that the assembly provides a perfect solution for customers who are having a hard time curling their hair with a flat iron. Their main difficulty comes from having to rotate the flat iron manually between 90° to 360°. This problem is solved by inventing a flat iron with a separate, electric rotating top.

One objective of the present invention is to provide a flat iron that automates the rotation of the tongs for facilitating curling or waving hair strands.

Another objective is to wind the tongs automatically in order to avoid the awkward manual twisting motion which makes it difficult for a user to style their own hair.

Yet another objective is to rotate the tongs up to 180° in both directions.

Yet another objective is to transfer sufficient and accurate pressure from the lever on the handle on the lower body to activate the scissors action on the upper body and firmly compress the heated irons, while transferring this energy through a rotating shaft.

Another objective is to avoid hair entanglement while delivering successful mechanical scissor and rotation movement.

An exemplary objective is to fit an appropriate motor, enclosure, and drive train within space constraints.

Yet another objective is to supply the motor with enough electrical power to output the torque required to rotate the arms through resistance, versus the space allowed for the transformer.

Yet another objective is to provide extensive refinement of tolerances to provide just enough clearance to avoid component movement while delivering smooth mechanical movement.

An exemplary objective is to engineer electrical control of 6 channels to communicate through a rotating interface.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 3*a* shows the tongs in the open position while rotating, FIG. 3*b* shows the tongs in the open position ready to accept hair strands, and FIG. 3*c* shows the tongs squeezed to a closed position, in accordance with an embodiment of the present invention;

FIG. 4*a* shows the tongs in the closed position clamped onto a hair strand, FIG. 4*b* shows the tongs being pulled longitudinally along the length of hair strand, FIG. 4*c* shows the tongs automatically rotating the hair strands while the handle remains stationary, and FIG. 4*d* shows the finished curled hair strand, in accordance with an embodiment of the present invention;

FIG. 5*a* shows the tongs clamped to the hair strands, and FIG. 5*b* shows the tongs rotating the hair strands in a first direction, in accordance with an embodiment of the present invention.

Like reference numerals refer to like parts throughout the various views of the drawings.

DETAILED DESCRIPTION OF THE INVENTION

Figure 1A:
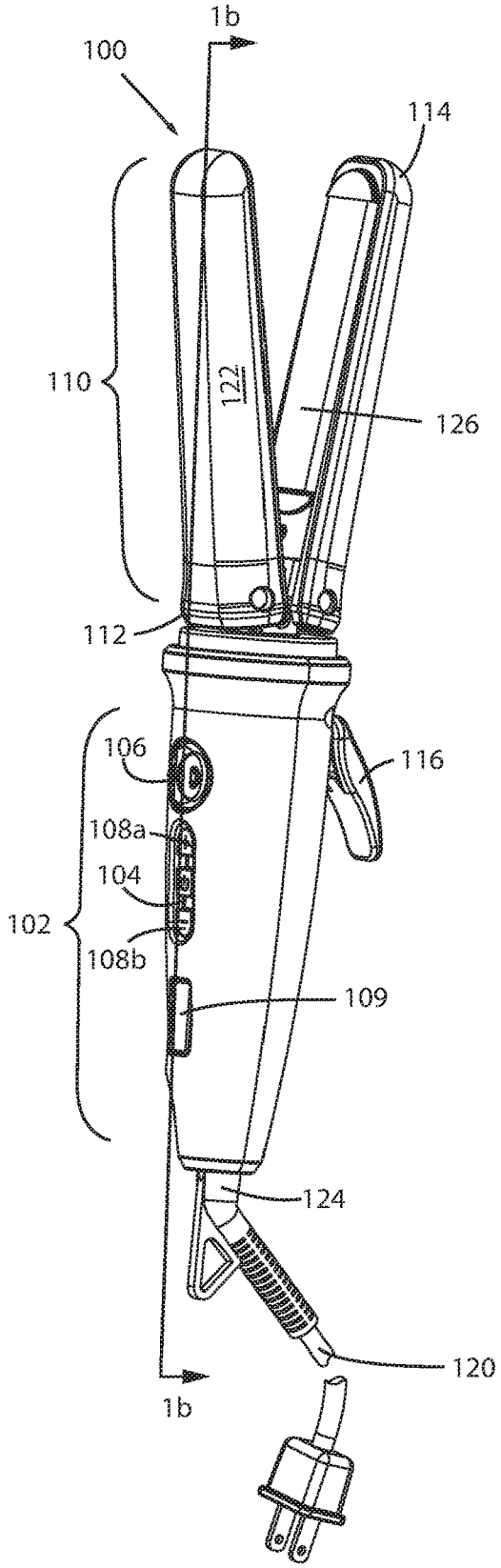
FIG. 1*a* illustrates a perspective view of an exemplary auto-rotate hair iron assembly in an open position, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

An auto-rotate hair iron assembly 100 and method 600 of styling hair to achieve at least one curl style based on extent of rotation is referenced in FIGS. 1*a*-6. Auto-rotate hair iron assembly 100, hereafter "assembly 100" is configured to clamp and heat hair strands 400 securely inside a pair of scissor-like tongs 110 while the tongs 110 simultaneously rotate in an automated manner, independently of the handle 102. The automated winding of the tongs 110 eliminates the need to awkwardly twist the hands while rotating the tongs around the hair strands 400, since the tongs 110 rotate independently of the handle 102. Consequently, self-styling of the hair is facilitated.

Further, selective rotational angle of the tongs 110 works to alter the shape of the hair strands 400, such that the extent of the curl in the hair is dependent on the temperature and the extent of rotation by the tongs; thereby allowing for myriad hair styles with the same device. In one example, the degree of rotation determines the type or style of curls achieved in the hair strands. For example, a larger degree of rotation creates a tighter curl or radius angle, while a lesser degree creates a broader curl radius angle. In one exemplary function, the slower the tongs are pulled down along the length of the hair, the tighter the curl is.

However, the variable of heat is also part of the equation in determining the type/style of curl. The heat adjustability that is applied to the hair strand also allows for the unique control of curl types and styles. In any case, the rotation is controlled by the user, and with one hand, so as to facilitate self-styling of the hair strands. The user controls the degree of rotation by manipulating a rotate switch 106.

FIG. 1*a* illustrates a perspective view of an exemplary auto-rotate hair iron assembly in an open position, in accordance with an embodiment of the present invention, the auto-rotate hair iron assembly 100, comprises a handle 102 that is grasped during operation of the assembly 100. Handle 102 is generally elongated and cylindrical to enable easy, comfortable gripping by the hand. Handle 102 is defined by a cavity 200 that contains the electrical and mechanical components of the assembly 100. Handle 102 may have an elongated, cylindrical shape with a grip-type surface. A foam or other insulator may cover handle 102 for protection and comfort. FIG. 1*a* further illustrates that, heat switch 108*a* comprises a (+) sign to indicate increasing the heat incrementally, and a (−) sign, to indicate reducing heat to tongs in an incremental manner. The heat generated in tongs 110 works to denature the hair; and thereby alter the appearance of the styled hair strands 400. Switches 104, 106, 108*a*-*b* can be disposed in any order along the longitudinal of the handle, being fully accessible by the thumb or any other finger for manipulation thereof. In one non-limiting embodiment, a screen 109 provides a digital readout of the heat settings and power status.

Figure 1B:
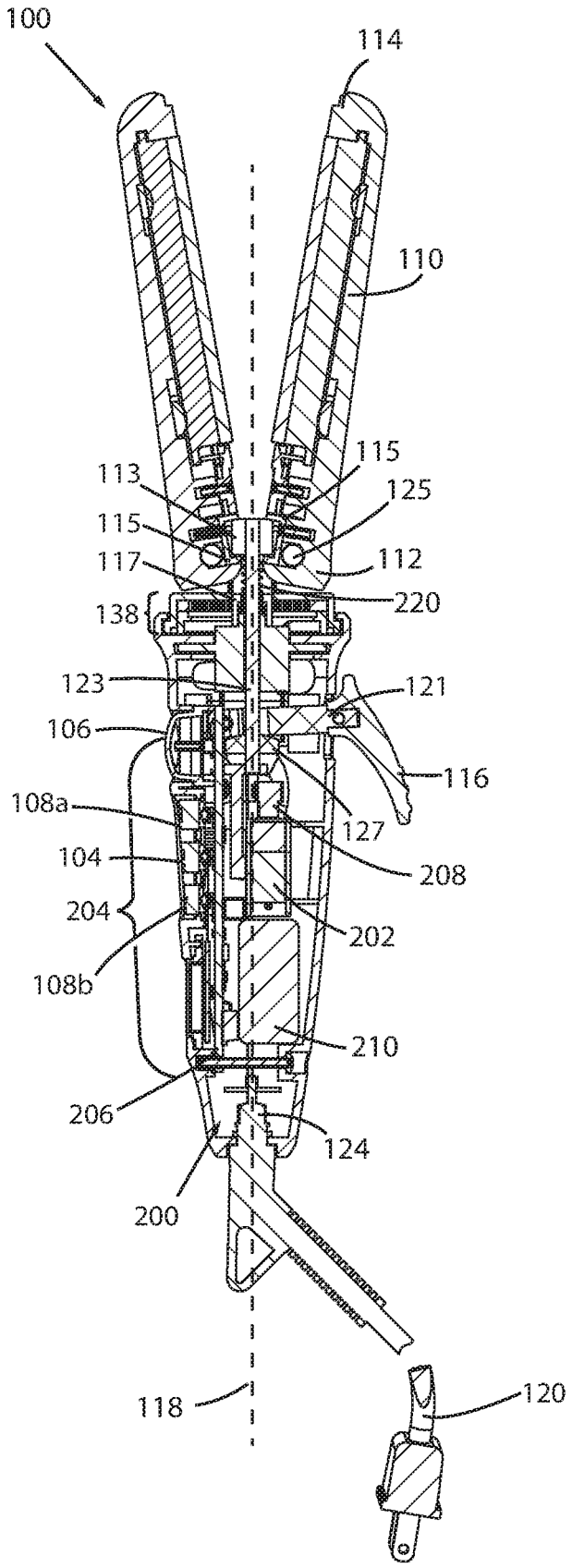
FIG. 1*b* illustrates a sectioned side view of the auto-rotate hair iron assembly in the open position, the section taken along section 1*b*-1*b* of FIG. 1*a*, detailing electrical components in the cavity of the handle, in accordance with an embodiment of the present invention.

FIG. 1*b* illustrates a cross sectional side view of the auto-rotate hair iron assembly in the open position, the section taken along section 1*b*-1*b* of FIG. 1*a*, detailing electrical components in the cavity 200 of the handle, in accordance with an embodiment of the present invention. The handle 102 includes a power switch 104, a rotate switch 106, and a heat switch 108*a*, 108*b*. These switches are configured to enable one-handed control of heating and rotation of the tongs 110. Power switch 104 is operable to power on and off a motor 202. Rotate switch 106 is a rocker switch, operable to rotate the tongs 110 in both directions up to 180°, so that pressure on one side of rotate switch 106 will rotate tongs in one direction and pressure on the other side of the switch will rotate the tongs in the other direction. Heat switch 108*a*-*b* works to regulate a heating element 126 in the tongs 110 to generate variable amounts of heat thereon. In one embodiment, rotate switch 106 has a left button and a right button for rotation in two directions.

FIG. 1*b* further illustrates assembly 100 which comprises a tong lever 116 that is operatively connected to tongs 110 via a center rod assembly 123 and trigger base 121. The trigger base is affixed to the tong lever 116. The center rod assembly 123 is situated along the central axis 118 as part of electrical circuitry 204. The center rod assembly 123 is composed of a cam 113 which is fixedly attached proximate the first end 112 on the center rod assembly 123 and a lower cam 127 at the end of center rod assembly 123 inside cavity 200 of handle 102. Cam 113 can be constructed of any resilient material such as brass or other metal. The lower cam 127 is secured to the center rod assembly 123. The lower cam 127 engages with the trigger base 121. The trigger base 121 is secured in cavity 200 of the handle 102 via trigger brackets 129 (see FIG. 2*b*) to allow trigger base 121 to pivot in a way such that the center rod assembly 123 moves along the central axis 118 when the tong lever 116 is engaged or disengaged. The brass cam inserts 115 are affixed inside tongs 110. When the tong lever 116 is actuated, the center rod assembly 123 moves along the central axis 118 with downward force and the brass cam 113 operatively engages with the brass cam inserts 115, resulting in the closing of the tongs 110 (see FIG. 1*f*). The tong bracket has a pivot point which allows the trigger base to pivot on an axis relative to the central axis allowing the center rod assembly 123 to move up and down. Spring 220 biases tongs 110 to the open position 300 (see FIG. 3*b*). Spring 220 is housed inside tong bracket 117. Assembly 100 further comprises a motor 202 that is disposed inside the cavity 200 of the handle 102. Motor 202 in operatively connected to the power switch 104 and the rotate switch 106. In this manner, the power switch 104 selectively powers on and off the motor 202 and the heating element 126. Motor 202 has enough electrical power to output the torque required to rotate the tongs through resistance, versus the space allowed for the transformer. In one non-limiting embodiment, motor 202 comprises a 460 rpm micro-gear motor. However, in other embodiments, different types of small electrical motors may also be used. Motor 202 has enough electrical power to output the torque required to rotate the tongs through resistance, versus the space allowed for the transformer.

Figure 1C:
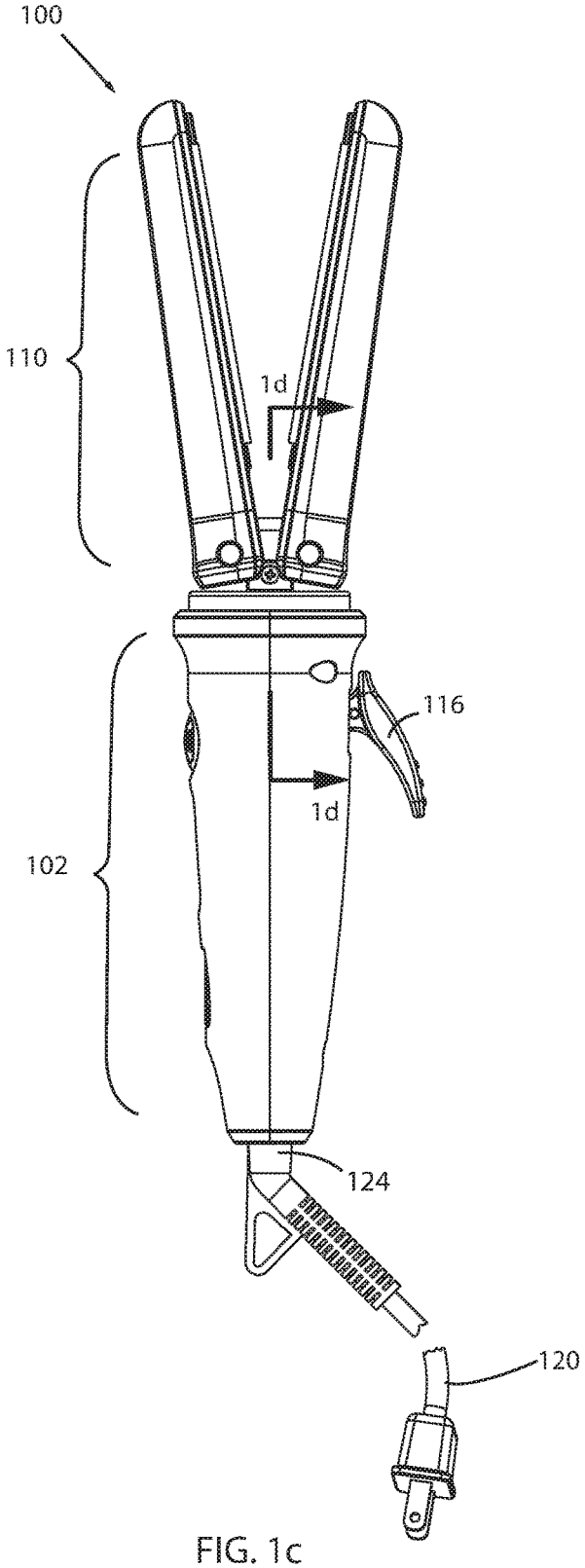
FIG. 1*c* illustrates a side perspective view of the auto-rotate hair iron assembly in an open position, in accordance with an embodiment of the present invention.

Looking now at FIG. 1*c*, the handle 102 comprising switches 104, 106, 108*a-b* may have a smooth surface. In other embodiments, switches 104, 106, 108*a-b* may have a tactile indicator, such as small bumps on the surface that help differentiate between switches. The tactile indicator may be useful in dark conditions, or for visually impaired users.

In one embodiment, the cavity 200 of handle 102 provides electrical circuitry 204 for carrying electricity between motor 202, power cord 120, switches 104, 106, 108*a-b*, screen 109 and other electrical components described below. Further, assembly 100 may include a printed circuit board (PCB) 206 that operatively connects to the motor 202 and the heating element. PCB is configured to mechanically support and electrically connect electronic components using conductive tracks, pads, and other features etched from multiple sheets of copper laminated onto the sheet layers of non-conductive substrate.

Figure 1D:
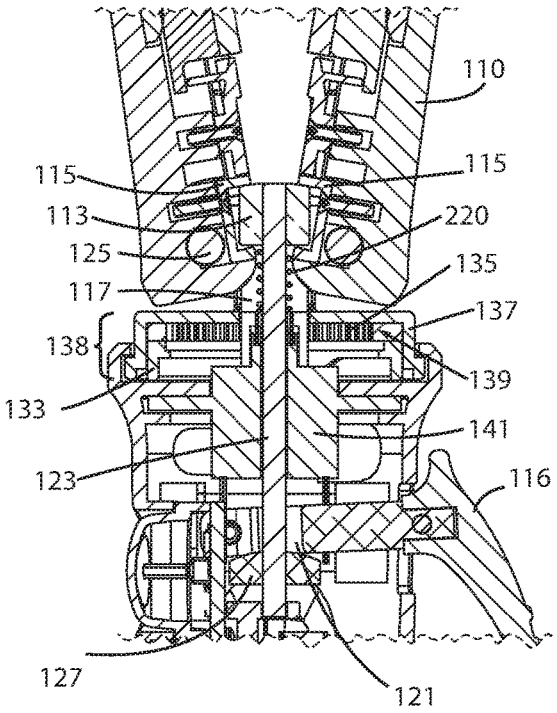
FIG. 1*d* illustrates a close-up sectioned side view of the tong/handle area of the auto-rotate hair iron assembly, the section taken along section 1*d*-1*d* of FIG. 1*c*, detailing internal components in the open position, in accordance with an embodiment of the present invention.

Turning now to sectioned view of assembly, shown in FIG. 1*d*, which illustrates a sectioned side view of the tong/handle area of the auto-rotate hair iron assembly, the section taken along section 1*d*-1*d* of FIG. 1*c*, detailing internal components in an open position. Assembly 100 comprises a tong lever 116 that is operatively connected to tongs 110 via a center rod assembly 123 and trigger base 121. Trigger base 121 is affixed to tong lever 116. Center rod assembly 123 is disposed along the central axis 118, terminating at a lower cam 127 that holds the center rod assembly 123 in a stable, axial position inside cavity 200 of handle 102. In one embodiment, center rod assembly 123 is composed of an upper cam 113 which is fixedly attached proximate the first end on the center rod assembly 123 and a wedge at the end of center rod assembly 123 inside cavity 200 of handle 102. Upper Cam 113 can be constructed of any resilient material such as brass or other metal. The lower cam 127 engages with the trigger base 121. Spring 220 biases tongs 110 to the open position 300 (see FIG. 3*b*). Spring 220 is housed inside tong bracket 117. It should also be understood that electrical current is delivered to heating the element through slip ring 141. Slip ring 141 allows transmission of power and electrical signals from the stationary handle 102 to the rotating structure, tongs 110. Slip ring 141 allows free rotation of tongs 110 without the concern of wires tangling during rotation. The trigger base 121 is secured in cavity 200 of the handle 102 via trigger brackets 129 (see FIG. 2*b*) to allow trigger base 121 to pivot in a way such that the center rod assembly 123 moves along the central axis 118 when the tong lever 116 is engaged or disengaged. The brass cam inserts 115 are affixed inside tongs 110. When the tong lever 116 is released, the center rod assembly 123 moves along the central axis 118 with upward force and the brass cam 113 operatively engages with the brass cam inserts 115, resulting in the opening of the tongs 110.

Figure 1E:
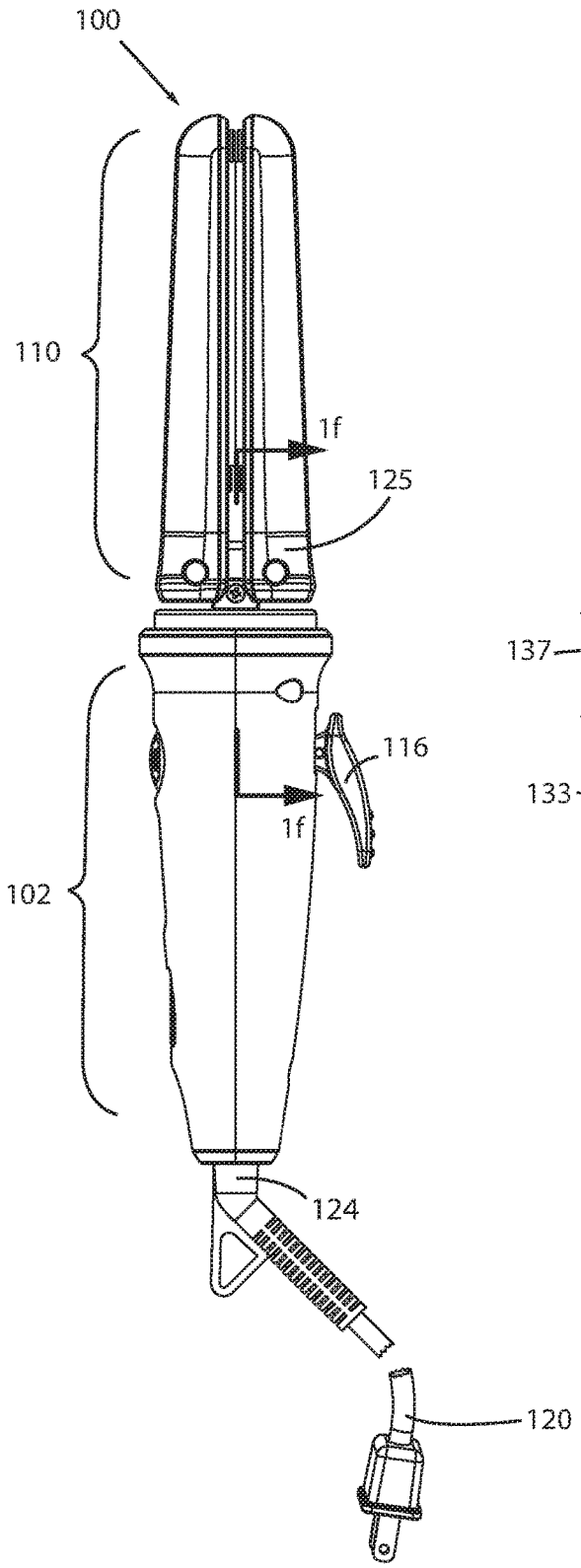
FIG. 1*e* illustrates a perspective view of the auto-rotate hair iron assembly in a closed position, in accordance with an embodiment of the present invention.

FIG. 1*e* illustrates a perspective view of the auto-rotate hair iron assembly in a closed position, wherein assembly 100 comprises an elongated heating element 126 comprises a power cord 120 for powering motor 202 with external electricity. The power cord couples to an external power source, such as an electrical outlet, from one end, and to the motor 202 from an opposite end. In one non-limiting embodiment, a power cord connector 124 joins the power cord 120 to the motor 202, or to electrical circuitry 204. The power cord connector 124 may include a conductive component that resides in the cavity 200 of the handle 102, and connects directly, or indirectly, to the motor 202. This allows for an external source of power transmitted through power cord 120 and power supply 210. Power supply 210 receives power from an electrical outlet and converts the current from AC (alternating current) to DC (direct current). In an alternative embodiment, a power supply 210 is a battery operatively connected to the motor 202 for powering thereof. This allows for dual sources of power-power cord 120 and battery.

Figure 1F:
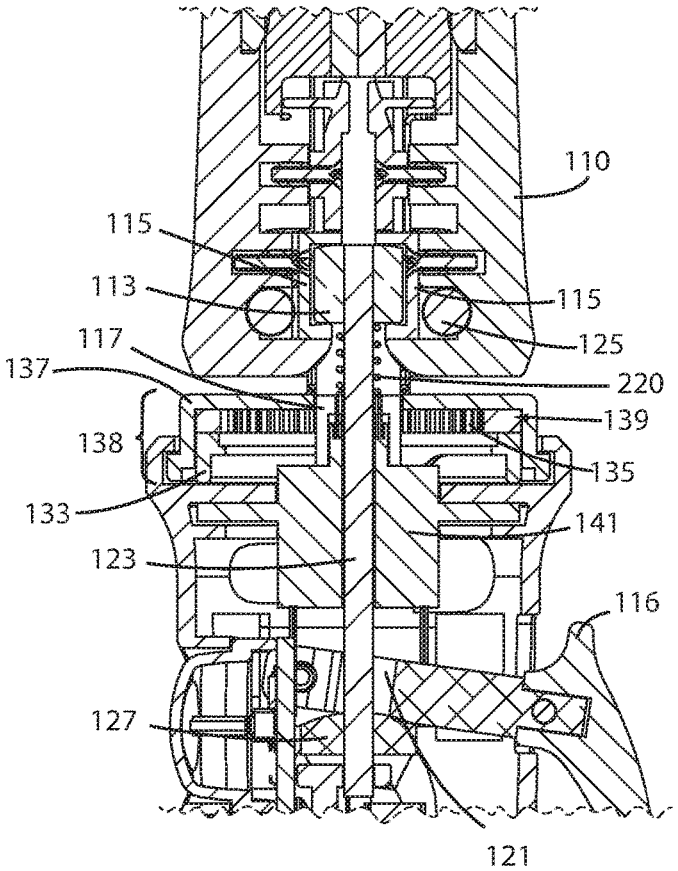
FIG. 1*f* illustrates a sectioned side view of the auto-rotate hair iron assembly, the section taken along section 1*f*-1*f* of FIG. 1*e*, detailing internal components in the closed position, in accordance with an embodiment of the present invention.

Turning now to sectioned view shown in FIG. 1*f*, that illustrates a sectioned side view of the auto-rotate hair iron assembly, the section taken along section 1*f*-1*f* of FIG. 1*e*, detailing interior components in the closed position. The trigger base 121 is secured in cavity 200 of the handle 102 via trigger brackets 129 (see FIG. 2*b*) to allow trigger base 121 to pivot in a way such that the center rod assembly 123 moves along the central axis 118 when the tong lever 116 is engaged or disengaged. The brass cam inserts 115 are affixed inside tongs 110. When the tong lever 116 is actuated, the center rod assembly 123 moves along the central axis 118 with downward force and the brass cam 113 operatively engages with the brass cam inserts 115, resulting in the closing of the tongs 110.

Figure 2A:
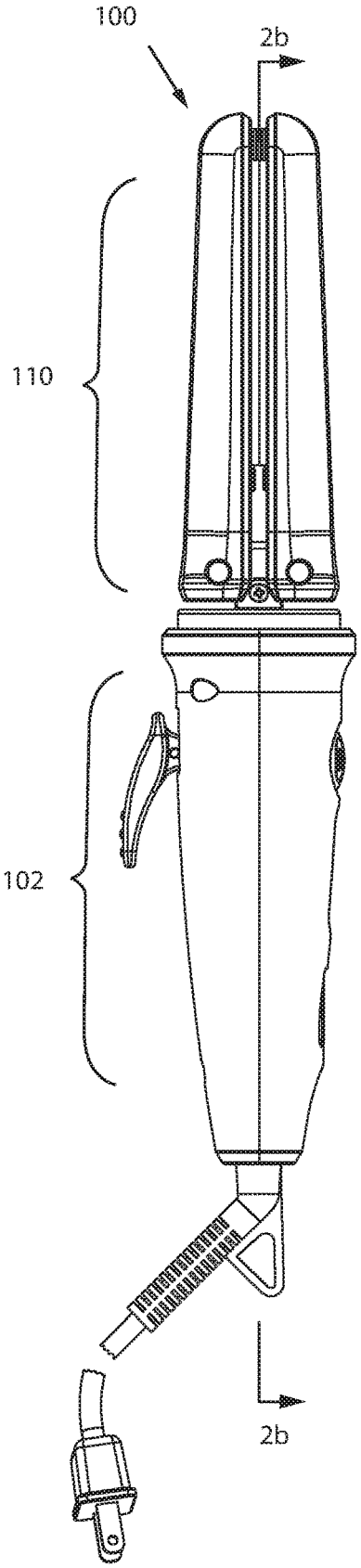
FIG. 2*a* illustrates a side perspective view of the auto-rotate hair iron assembly in a closed position, in accordance with an embodiment of the present invention.

FIG. 2*a* illustrates a side perspective view of the auto-rotate hair iron assembly in a closed position, in accordance with an embodiment of the present invention.

Figure 2B:
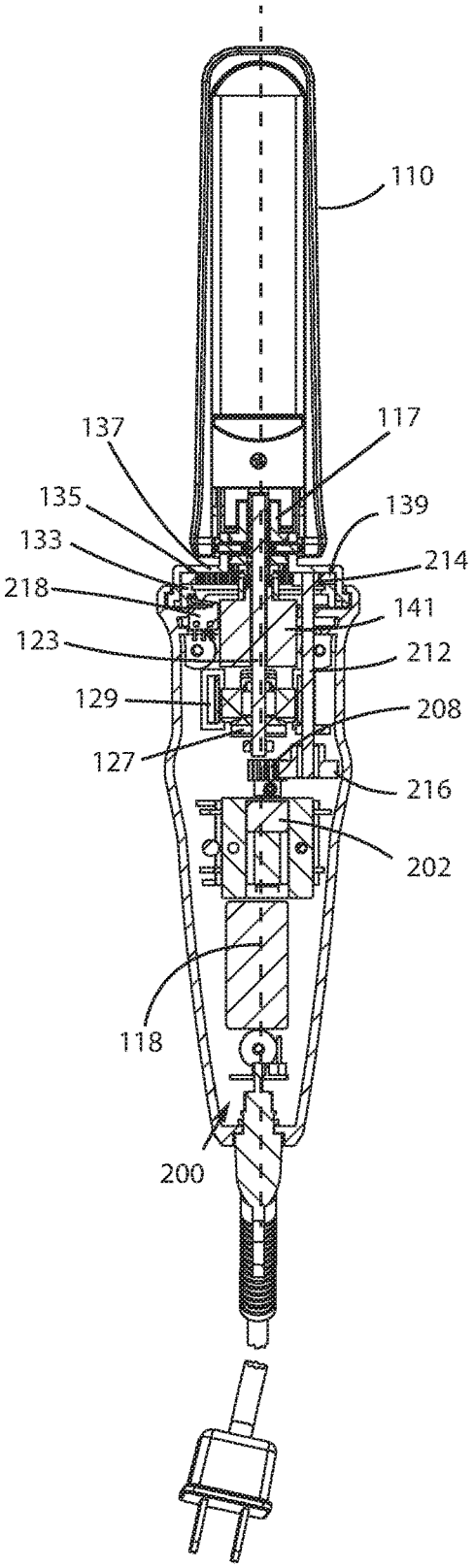
FIG. 2*b* illustrates sectioned side view of the tong/handle area of the auto-rotate hair iron assembly, the section taken along section 2*b*-2*b* of FIG. 2*a*, detailing the drive shaft assembly and rotational components in the handle and collar cavity, in accordance with an embodiment of the present invention.

FIG. 2*b* illustrates a close-up sectioned side view of the tong/handle area of the auto-rotate hair iron assembly, the section taken along section 2*b*-2*b* of FIG. 2*a*, detailing electrical components in the handle, in accordance with an embodiment of the present invention. As shown in FIG. 2*b*, assembly 100 may include a drive shaft 212 for transferring rotational force from motor 202. The drive shaft is comprised of a gear on either end, one being the handle end gear 216, and the other being the collar end gear 214. The collar assembly 138 comprises an end gear 214, limit trigger 133, and ring gear 135 are disposed inside collar cavity 139. The collar end gear 214 rotationally drives ring gear 135 which is permanently fixedly attached to collar 137. The collar 137 is connected to handle 102 in a way that the collar 137 is secured along central axis 118 but can rotate freely. The collar 137 and the tongs 110 are mechanically connected through tong bracket 117 and tong pins 125 (shown in FIG. 1*b*). The handle end gear 216 of drive shaft 212 is disposed inside the cavity 200 of the handle 102 parallel to central axis 118. Handle end gear 216 of drive shaft 212 operatively connects to motor 202 and rotate switch 106. A motor gear assembly 208 allows motor to rotationally initiate rotation of drive shaft 212. Technically, when the motor is powered on, it turns the connected gear, which engages with the driveshaft. The rotation of driveshaft 212 initiates rotation of ring gear 135 which subsequently rotates collar 137. Since collar 137 and tongs 110 are attached, the tongs 110 rotate when the drive shaft 212 is powered by rotate switch 106. Stop member 218 engages with limit trigger 133 which is a flanged ring that is used to restrict rotation. Stop member 218 is an electrical short circuit operable to restrict automated rotation that limits the tongs 110 to a predetermined position relative to handle 102 such as 180° for example.

Figure 3A:
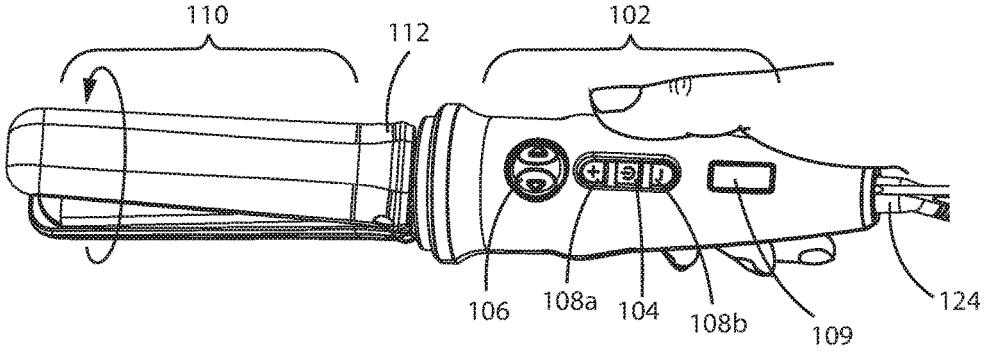
FIGS. 3*a*-3*c* illustrate perspective view of the auto-rotate hair iron assembly rotating, where
Figure 3B:
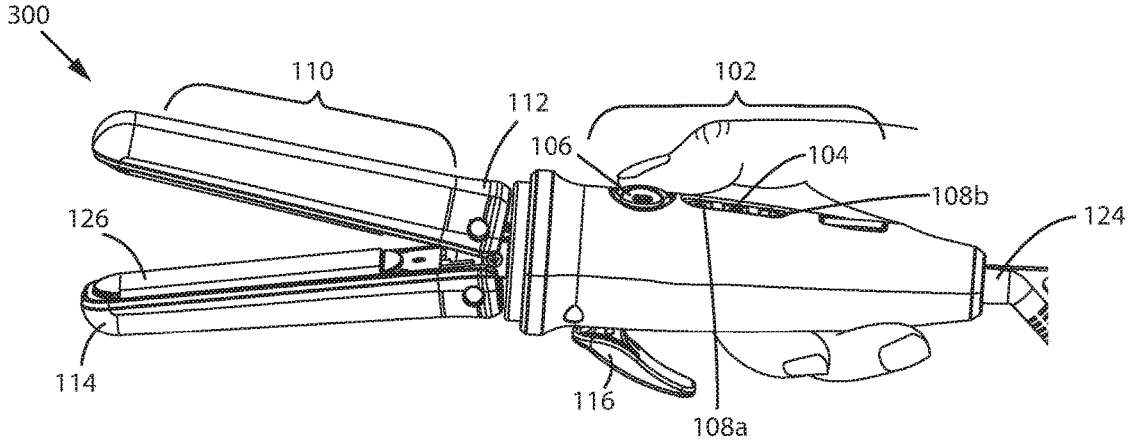
Figure 3C:
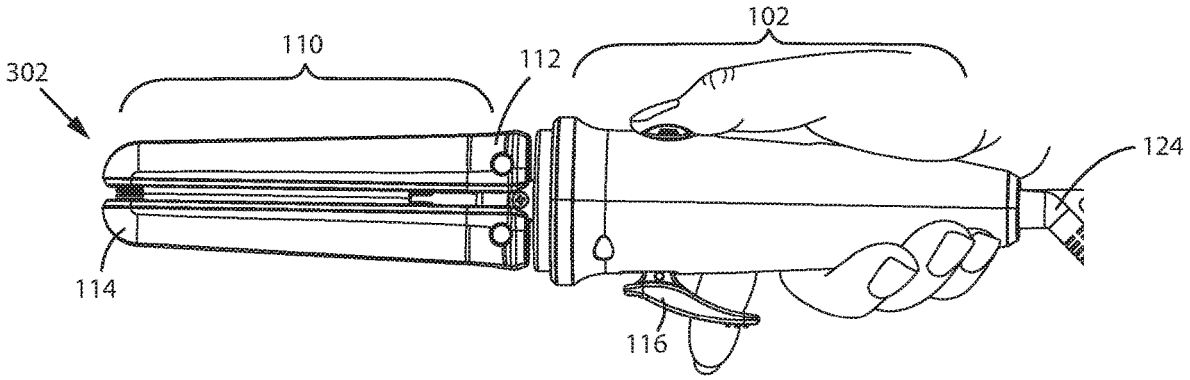

As FIGS. 3*b* and 3*c* show, assembly 100 may include a pair of scissor-like tongs 110 arranged in a spring-loaded, clamping relationship. As FIG. 3*a* illustrates, Tongs 110 are configured to clamp, rotate and release the hair strands 400. Tongs 110 are defined by a first end 112 rotatably coupled to tong end of the drive shaft 212. Tongs 110 are further defined by a second end 114 spaced from first end 112 in a direction of elongation. Rotate switch 106 is operatively attached to drive shaft 212, so as to selectively drive tongs 110 into rotation, up to 360° (FIG. 3*a*). In this manner, the assembly 100 is configured to engineer an electrical control of 6 channels, so as to communicate through the rotating interface of tongs.

Figure 4A:
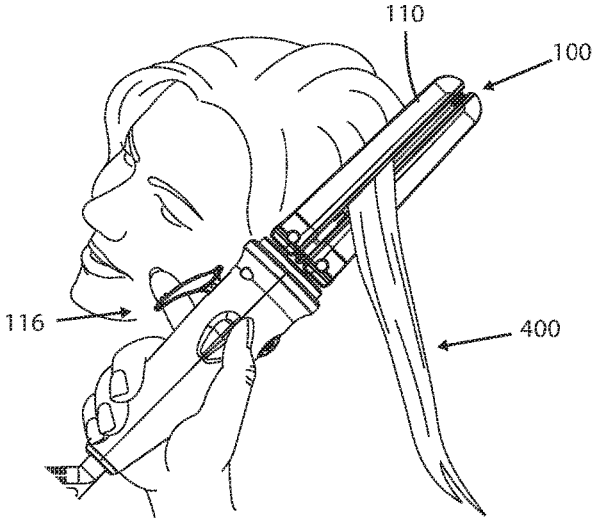
FIGS. 4*a*-4*d* illustrate perspective view of the auto-rotate hair iron assembly rotating a hair strand to achieve a curled hair strand, where
Figure 4B:
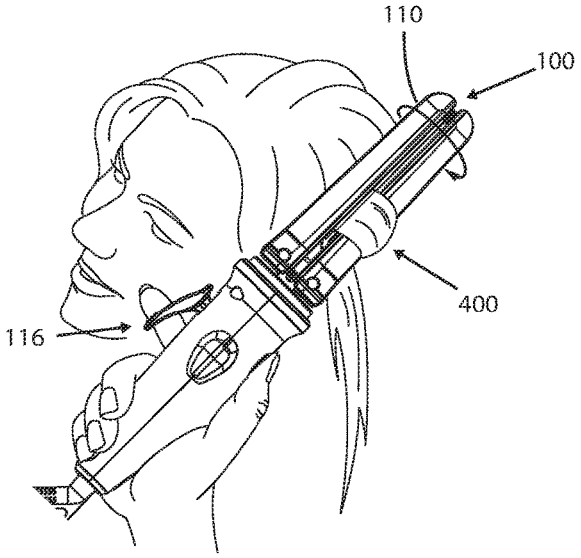
Figure 4C:
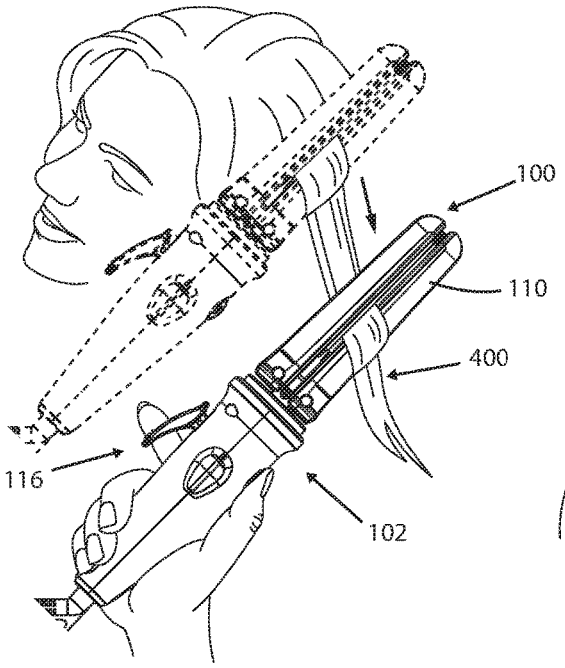
Figure 4D:
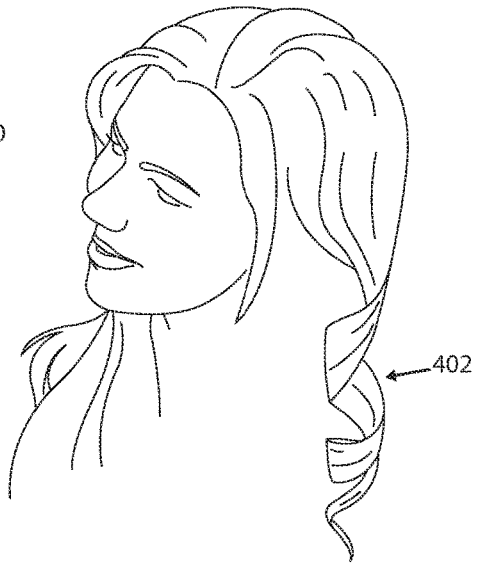

Thus, as shown in FIGS. 4*a*-4*d*, the assembly 100 forms waves, or curls, in hair strands 400 by clamping tongs 110 around a strand of hair, applying heat to tongs 110, and pulling tongs 110 longitudinally along the length of the hair strands 400 (FIG. 4*a*). Further, as FIG. 4*b* illustrates, the assembly 100 provides the unique function of automating the rotation of tongs 110 up to 360° in either direction while handle 102 remains stationary, so as to achieve the desired wave or curl in the hair (FIG. 4*c*). At least one curl style 402 may be achieved in this manner. For example, FIG. 4*d* shows a wavy curl style 402 achieved by rotating the tongs more than 270°. However, other curl styles may also be achieved by changing the amount of heat applied and/or changing the degree of rotation.

Tongs 110, which are spring-loaded, are biased in an open position for receiving and withdrawing hair strands 400, and an open position for retaining the hair strands 400. In one non-limiting embodiment, a spring 220 is disposed at the nexus of pair of tongs 110, at or near first end 112. Spring 220 biases tongs 110 to the open position 300. The closed position 302 applies force to the hair strands 400 for altering appearance thereof. In some embodiments, the assembly 100 further comprises a ceramic housing 122 that encapsulates the tongs 110. The ceramic housing 122 is configured to temper the heat generated in the tongs 110, as described below. Ceramic housing 122 can comprise any material well known in the art to insulate the heat generated by the heating elements in the tongs 110, such as ceramic, Teflon®, silica, mica, fiberglass or high-temperature thermoplastic.

In some embodiments, an electrical current is delivered to heating element 126 through a slip ring 141. Slip ring 141 allows transmission of power and electrical signals from the stationary handle 102 to the rotating structure, tongs 110. Slip ring 141 allows free rotation of tongs 110 without the concern of wires tangling during rotation.

Thus, for making or changing a hairstyle, a strand of hair 400 is secured between the pair of scissor-like tongs 110 while in the open position 300. As shown in FIG. 4*a*, tongs 110 are engaged to the closed position 302, so as to clamp down on the hair strands 400.

Thus, when the hair strands 400 are secured and stranded between tongs 110, the pressure and the heat of the tongs 110, along with the rotation of the tongs 110, forms the desired curve or wave style 402 (FIG. 4*d*). In some embodiments, assembly 100 comprises an elongated heating element 126 that is disposed within tongs 110, extending partially in the direction of elongation between the first and second ends 112, 114 of tongs 110. Heating element 126 is operatively connected to heat switch 108*a*, 108*b*, whereby the heat switch 108*a*, 108*b* selectively actuates the heating element to generate heat. In one embodiment, heating element generates heat up to 450° Fahrenheit. In one non-limiting embodiment, heating element 126 is a flat metal panel that resists electricity through the circuitry 204 until heat is generated as a result. Or heating element 126 may operate by conducting electricity from internal components in cavity 200 of handle 102.

Figure 5A:
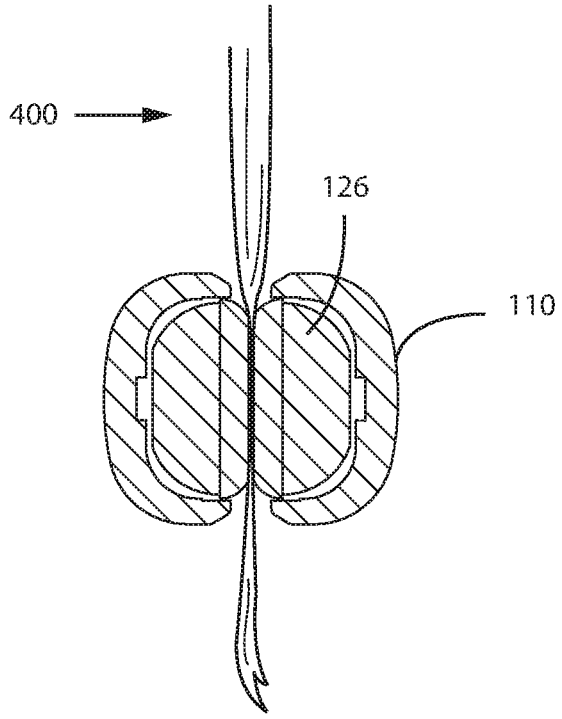
FIGS. 5*a*-5*b* illustrate perspective view of the tongs clamped onto the hair strands, where
Figure 5B:
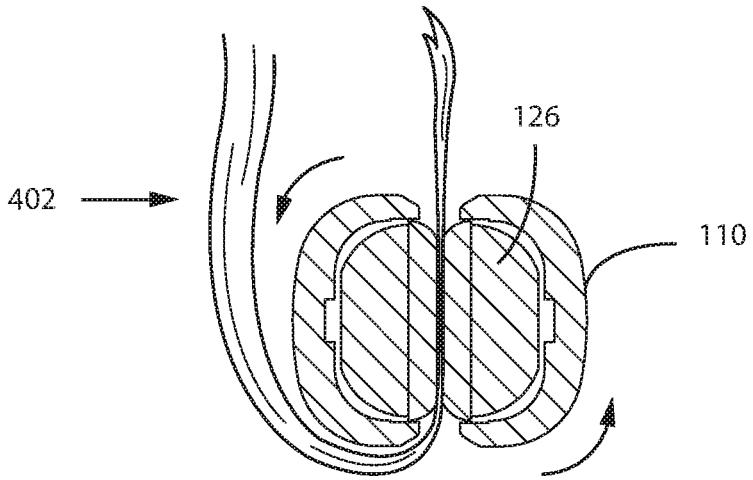

FIGS. 5*a*-5*b* illustrate perspective view of the tongs clamped onto the hair strands, where FIG. 5*a* shows the tongs clamped to the hair strands, and FIG. 5*b* shows the tongs rotating the hair strands in a first direction, in accordance with an embodiment of the present invention. To restrict rotation of drive shaft 212 to the 180° range, a stop member 218 is used to physically prevent the rotation of rotary bar 212 beyond a predetermined rotation range of 180°. For example, FIG. 5*b* shows the rotation of rotary bar 212 and tongs 110, described below, restricted to a counterclockwise rotation at 180°. In some embodiments, limit trigger 133 may include a barrier or flange ring that sets at a predetermined position between handle 102 and tongs 110. However, in other embodiments, stop member 218 may be and barrier or electrical short circuit operable to restrict automated rotation. In yet another embodiment, stop member 218 is configured to enable rotation greater than 180°.

Figure 6:
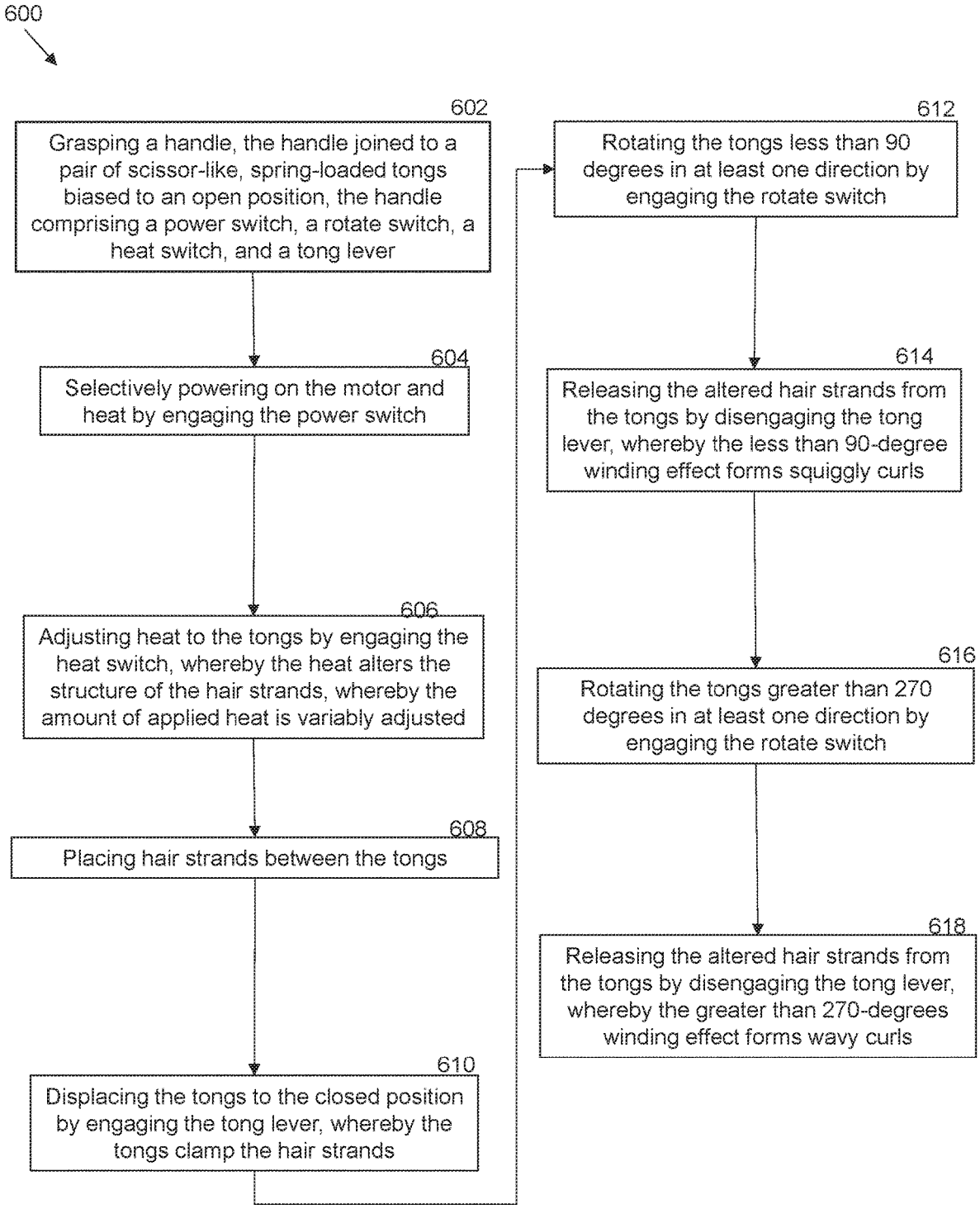
FIG. 6 illustrates a flowchart diagram of an exemplary method of styling hair with an auto-rotate hair iron assembly to achieve at least one curl style based on extent of rotation, in accordance with an embodiment of the present invention.

FIG. 6 illustrates a flowchart diagram of an exemplary method 600 of styling hair with an auto-rotate hair iron assembly to achieve at least one curl style based on extent of rotation. Method 600 solves an existing problem for customers who find it difficult and challenging to curl their hair with their regular flatiron by turning a flat iron into a curling iron with a simple press of a button. The degree of rotation determines the type or style of curls achieved in the hair strands. For example, a larger degree of rotation creates a tighter curl or radius angle, while a lesser degree creates a broader curl radius angle. In any case, the degree of rotation is controlled by the user, and with one hand, so as to facilitate self-styling of the hair strands.

Method 600 may include an initial Step 602 of grasping a handle, the handle joined to a pair of scissor-like, spring-loaded tongs biased to an open position, the handle comprising a power switch operatively connected to a motor, a rotate switch operatively connected to the tongs, a heat switch operatively connected to a heating element, and a tong lever operational to displace the tongs between an open position and a closed position. Power switch 104 is operable to power on and off a motor 202. Rotate switch 106 is operable to rotate the tongs 110 in both directions up to 90° for looser curls, and above 90° for tighter curls. Heat switch 108*a*, 108*b* works to regulate a heating element 126 in the tongs 110 to generate variable amounts of heat thereon.

Method 600 may further comprise a Step 604 of selectively powering on the heat and the motor by engaging the power switch.

A Step 606 includes adjusting heat to the tongs by engaging the heat switch, whereby the heat alters the structure of the hair strands, whereby the amount of applied heat is variably adjusted.

A Step 608 comprises placing hair strands between the tongs and a Step 610 comprising squeezing the tongs to the closed position by engaging the tong lever, whereby the tongs clamp the hair strands. FIG. 5*a* shows the tongs clamped firmly about the hair strands.

A Step 610 includes applying heat to the hair, whereby the heat alters the structure of the hair strands, whereby the amount of applied heat is variably adjustable. In one embodiment, heat switch 108*a* comprises a (+) sign to indicate increasing the heat incrementally, and a (−) sign, to indicate reducing heat to tongs in an incremental manner. The heat generated in tongs 110 works to denature the hair; and thereby alter the appearance of the styled hair strands 400.

In some embodiments, a Step 612 may include rotating the tongs less than 90 degrees in at least one direction by engaging the rotate switch. As illustrated in FIG. 4*c*, the tongs may then be pulled along the length of the hair strands in a longitudinal direction. The pressure and the heat of the tongs 110, along with the rotation of the tongs 110, form the squiggly curve or wave in hair strands 400. As illustrated, the tongs rotate 90° or less, while the handle remains stationary. This prevents the awkward bending of the wrist commonly encountered when manually rotating the tongs.

A Step 614 comprises releasing the altered hair strands from the tongs by disengaging the tong lever, whereby the less than 90-degree winding effect forms squiggly curls. FIG. 4*d* shows the tong lever 116 being released to enable the first end 112 of the tongs 110, and the spring 220 therein, to displace the tongs 110 to the open position 300. Consequently, the hair strands 400 are released from tongs 110.

Method 600 may further comprise a Step 616 of rotating the tongs below or greater than 90 degrees in at least one direction by engaging the rotate switch. As illustrated, the tongs rotate 90° or more, while the handle remains stationary. This prevents the awkward bending of the wrist commonly encountered when manually rotating the tongs. However, it is significant to note that some of this hair iron assemblies may be manufactured with a rotate switch that limits the rotation to less than 90 degrees in order to achieve looser curls, and some will be manufactured with a rotate switch that limits the rotation to a point above 90 degrees in order to achieve tighter spiral curls. In any case, the stop member restricts rotation of the drive shaft at the predetermined rotational range. Also, the direction of rotation (left or right) of the tongs is controllable by the user through manipulation of the rotate switch.

A final Step 618 includes releasing the altered hair strands from the tongs by disengaging the tong lever, whereby the greater than 90-degree winding effect forms tightly spiral curls. Consequently, the hair strands 400 are secured and stranded between tongs 110, the pressure and the heat of the tongs 110, along with the rotation of the tongs 110, forms the tight curve or wave in the hair strands 400. In any case, the speed at which the tongs are pulled along the length of the hair also determines the tightness of the curl.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A hair iron assembly, comprising:

a handle defined by a cavity, the handle comprising a power switch, rotation pre-set button, and a heat switch;

a motor disposed inside the cavity of the handle, the motor being operatively connected to the power switch and the rotation pre-set button, whereby a power switch selectively powers on and off the motor and at least one heating element;

wherein the rotation pre-set button includes a right button and a left button for pre-setting a rotational direction of a pair of tongs;

a stop limit switch for restricting rotation of a drive shaft;

a lever operatively connected to a first end of the tongs, the lever being operable to engage the tongs to a closed position;

a connector on the lever for contacting an actuator on a lever limit switch when the lever is fully depressed;

wherein activation of the lever limit switch initiates rotation of the pair of tongs.

2. The assembly of claim 1, wherein the rotation pre-set button includes a right button and a left button for pre-setting the rotational direction of the tongs.

3. The assembly of claim 1, wherein the rotation pre-set button selectively drives the tongs into rotation up to 180 degrees in at least one direction.

4. The assembly of claim 1, wherein the assembly may be set to a non-rotation mode until a direction is selected by a user.

5. The assembly of claim 1, wherein a rotation pre-set button sends a message electronically to a sensor to indicate to the sensor whether to turn the motor left, right or to stay in position when the switch lever comes in contact with the sensor.

6. The assembly of claim 1, wherein the lever limit switch is affixed to the handle.

7. The assembly of claim 1, wherein a drive shaft defined by a handle end and a tong end, the drive shaft disposed inside the cavity of the handle along a central axis, the handle end of the drive shaft being operatively connected to the motor and the rotation pre-set button, whereby the lever causes the drive shaft to be driven into rotation by the motor.

8. The assembly of claim 1, wherein the heat switch selectively increases or decreases a heating element temperature.

9. A hair iron assembly, comprising:

a handle defined by a cavity, the handle comprising a power switch, rotation pre-set button, and a heat switch;

a motor disposed inside the cavity of the handle, the motor being operatively connected to a power switch and the rotation pre-set button, whereby the power switch selectively powers on and off the motor and at least one heating element;

wherein the rotation pre-set button includes a right button and a left button for pre-setting a rotational direction of a pair of tongs;

a stop limit switch for restricting rotation of a drive shaft;

a lever operatively connected to a first end of the pair of tongs, the lever being operable to engage the pair of tongs to a closed position;

a sensor operatively connected to the lever such that the sensor is activated when the lever is fully depressed; wherein activation of the sensor initiates rotation of the tongs.

10. The assembly of claim 9, wherein the rotation pre-set button includes a right button and a left button for pre-setting the rotational direction of the pair of tongs.

11. The assembly of claim 9, wherein the rotation pre-set button selectively drives the tongs into rotation up to 180 degrees in at least one direction.

12. The assembly of claim 9, wherein the assembly may be set to a non-rotation mode until a direction is selected by a user.

13. The assembly of claim 9, wherein the rotation pre-set button sends a message electronically to the sensor to indicate to the sensor whether to turn the motor left, right or to stay in position when the switch lever comes in contact with the sensor.

14. The assembly of claim 9, wherein the sensor is affixed to the handle.

15. The assembly of claim 9, wherein a drive shaft defined by a handle end and a tong end, the drive shaft disposed inside the cavity of the handle along a central axis, the handle end of the drive shaft being operatively connected to the motor and the rotation pre-set button, whereby the switch lever causes the drive shaft to be driven into rotation by the motor.

16. The assembly of claim 9, wherein the sensor is a limit switch.

17. The assembly of claim 16, wherein the limit switch is contacted by a connector on the lever when the lever is fully depressed.

18. The assembly of claim 9, wherein the sensor is selected from a group consisting of an optical switch, an inductive switch or a capacitive switch.

19. A method of using a hair iron assembly, comprising:

pre-setting a degree of rotation for a pair of tongs;

setting a rotation pre-set button to right or left;

positioning the hair iron assembly on a user's hair;

depressing a lever to close tongs and initiate rotation of tongs when the tongs are closed;

automatically stopping rotation of tongs at the pre-set degree of rotation;

releasing the lever after rotation of tongs has stopped at the pre-set degree of rotation;

repositioning the hair iron assembly on the user's hair; depressing the lever to closing tongs to reinitiate rotation of tongs.

20. The method of claim 19, further comprising, pre-setting a temperature for heating elements in the tongs.

* * * * *